US007251840B2

(12) United States Patent
Bayer

(10) Patent No.: US 7,251,840 B2
(45) Date of Patent: Aug. 7, 2007

(54) DOUBLE REVERSIBLE CLOTHING

(76) Inventor: John J. Bayer, 124 Lawrence Ave., Bulter, PA (US) 16001

( * ) Notice: Subject to any disclaimer, the term of this patent is extended or adjusted under 35 U.S.C. 154(b) by 0 days.

(21) Appl. No.: 10/841,699

(22) Filed: May 6, 2004

(65) Prior Publication Data

US 2004/0250331 A1 Dec. 16, 2004

Related U.S. Application Data

(60) Provisional application No. 60/468,133, filed on May 6, 2003.

(51) Int. Cl.
*A41D 13/00* (2006.01)
*A41D 1/06* (2006.01)

(52) U.S. Cl. ..... 2/227; 2/DIG. 2; 2/228; 2/900

(58) Field of Classification Search ..... 2/69, 2/79, 227, 228, 238, 93–95, 96, 108, DIG. 2, 2/900, 243.1, 247–251, 244, 246
See application file for complete search history.

(56) References Cited

U.S. PATENT DOCUMENTS 1,337,698 A * 4/1920 Tomas ..... 2/247
3,317,923 A * 5/1967 Levi ..... 2/227
3,492,676 A * 2/1970 King ..... 2/114
5,029,344 A * 7/1991 Shannon et al. ..... 2/69
5,204,995 A * 4/1993 Knapp ..... 2/228
5,561,860 A * 10/1996 Nguyen-Senderowicz ..... 2/90
6,047,404 A * 4/2000 Blanks ..... 2/69
6,298,485 B1 10/2001 Heller
6,308,334 B1 10/2001 Maas
6,336,226 B1 1/2002 Garcia
6,345,393 B1 2/2002 Bayer
6,393,613 B1 5/2002 Sheu
6,397,393 B2 6/2002 Alger
6,405,377 B1 6/2002 Davis
6,421,833 B2 7/2002 Khanamirian et al.
6,421,834 B2 7/2002 Kester
6,647,551 B2 * 11/2003 Palumbo ..... 2/69
6,845,518 B1 * 1/2005 Boesen ..... 2/86

* cited by examiner

*Primary Examiner*—Gloria M. Hale
(74) *Attorney, Agent, or Firm*—John D. Gugliotta

(57) ABSTRACT

Double reversible clothing is provided which includes four-sided double reversible pants, coveralls, a hooded sweatshirt, and a jacket. The garments are adorned in various identifying indicia, including sports team logos and camouflage patterns typically associated with the seasons of spring, summer, winter, and fall.

2 Claims, 10 Drawing Sheets

DOUBLE REVERSIBLE CLOTHING

RELATED APPLICATIONS

This application claims the benefit of U.S. Provisional Application No. 60/468,133 filed May 6, 2003.

BACKGROUND OF THE INVENTION

1. Field of the Invention

The present invention relates generally to outdoor clothing, and, more particularly, to four-sided double reversible team jackets, hooded sweatshirts, overalls (coveralls), pants and vests that have four different patterns or indicia for customizing the appearance.

2. Description of Related Art

The ability to alter one's wardrobe in a matter of moments has been attempted in a variety of ways, including reversible garments that allow a user to simply reverse the lining of the garment to display a separate fabric, design or other identifying indicia. The use of a four-sided, double reversible garment is a cost effective mechanism for consumers to diversify a portion of their wardrobe without the expense of paying for four separate sets of clothing.

A search of the prior art did not disclose any patents that read directly on the claims of the instant invention; however, the following references were considered related:

| U.S. Pat. No. | Inventor | Issue Date |
|---|---|---|
| 6,345,393 B1 | Bayer | Feb. 12, 2002 |
| 6,421,834 B2 | Kester | Jul. 23, 2002 |
| 6,421,833 B2 | Khanamirian et al. | Jul. 23, 2002 |
| 6,405,377 B1 | Davis | Jun. 18, 2002 |
| 6,393,613 B1 | Sheu | May 28, 2002 |
| 6,397,393 B2 | Alger | Jun. 4, 2002 |
| 6,336,226 B1 | Garcia | Jan. 8, 2002 |
| 6,308,334 B1 | Maas | Oct. 30, 2001 |
| 6,298,485 B1 | Heller | Oct. 9, 2001 |

Consequently, a need has been felt for four-sided double reversible jackets, hooded sweatshirts, overalls, pants, and vest adapted with different patterns or indicia for customizing the appearance with camouflage to correspond with seasons and customizing with sports teams logos. The development of the double reversible clothing fulfills this need.

SUMMARY OF THE INVENTION

It is therefore an object of the present invention to provide four-sided, double reversible pants, coveralls, a sweatshirt, and a jacket, wherein each has at least four patterns which can be selectively worn and chosen according to wearer's taste and desire.

It is another object of the present invention to provide garments having at least four identifying indicia, including sports team logos, brand name logos, and camouflage styles typically associated with seasons of spring, summer, fall, and winter.

It is another object of the present invention to provide at least two patterns being printed on a first shell, wherein one of the patterns is printed on the outer surface of first shell, and a second pattern is printed on the inner surface of first shell.

It is another object of the present invention to provide at least two patterns being printed on a second shell, wherein one of the patterns is printed on the outer surface of second shell, and a second pattern is printed on the inner surface of second shell.

It is a feature of the present invention to provide garments with reversible, gusseted pockets, closure means, and drawstrings.

Briefly described according to one embodiment of the present invention, double reversible clothing is disclosed, and more particularly, four-sided double reversible pants, coveralls, hooded sweatshirt, and jacket are shown having four different patterns that can be selectively worn and chosen according to the wearer's taste and desire. It is envisioned that the garment would have four different identifying indicia, including sports team logos, brand name logos, camouflage styles that are typically associated with the seasons of spring, summer, fall, and winter, or other suitable indicia. Two of the patterns are printed on a first shell, one pattern printed on the outer surface, and the other printed on the inner surface. The remaining two patterns are printed on a second shell, one pattern printed on the outer surface and one printed on the inner surface. The first shell and second shell are essentially identical in shape except for differences related to the double reversible nature of the garment. Located on the front of the garment in each of the possible four configurations are a pair of drawstrings penetrating each shell by a series of four brass grommets allowing for conventional drawstring function.

Each shell is formed nearly identically to each other, and each is formed with a left sleeve or leg opposite the central zipper to the right sleeve or leg. Further, the central zipper has a flap that overlays the zipper, and is formed of a linearly elongated tab-like structure extending laterally inward from the inner seam of the shell.

The double reversible pants include a plurality of belt loops about the upper circumference of the pants, wherein the belt loops are integral to the circumference so that a belt may be inserted into all the reversible layers of the pants. Allowing for the belt to penetrate all the reversible layers permits the belt to fully support the pants regardless of which particular print or indicia is exposed for display. The pants further include a plurality of pockets secured to the garment by hook and loop material. The pants also include a fly secured by hook and loop material. The pants also include a pair of cold weather straps, one strap for each pant leg. The straps permit a user to draw the bottom of the leg tightly about the leg and prevent the intrusion of cold air, water or other similarly unwanted environmental hindrance or annoyance. The straps are reversible through a seam along the bottom of each leg.

A hooded sweatshirt is depicted as having similar qualities and characteristics as the pants, wherein the hooded sweatshirt is capable of adjustment to display four separate layers containing various prints or indicia through reversible adaptation. It is envisioned that the hooded sweatshirt includes cold weather straps or drawstrings for enclosing the hood tightly about the users head, and that the neck of the hooded sweatshirt will include hook and loop fasteners for closure of the neck portion. It is further envisioned that the pocket provided about the lower front of the hooded sweatshirt is reversible, as well.

A double reversible jacket is depicted, also having similar qualities and characteristics of the pants and hooded sweatshirt. It is envisioned that the jacket is similar to other commercially available jackets, but provided with double reversibility so as to allow the display of four separate layers containing various prints and indicia.

A double reversible coverall is depicted having the double reversible qualities previously disclosed. The coverall includes hook and loop fasteners about the front of the garment, a reversible front pocket near the waistline, reversible pockets approximating pants pockets and cold weather straps for cinching the lower portion of the coverall legs.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
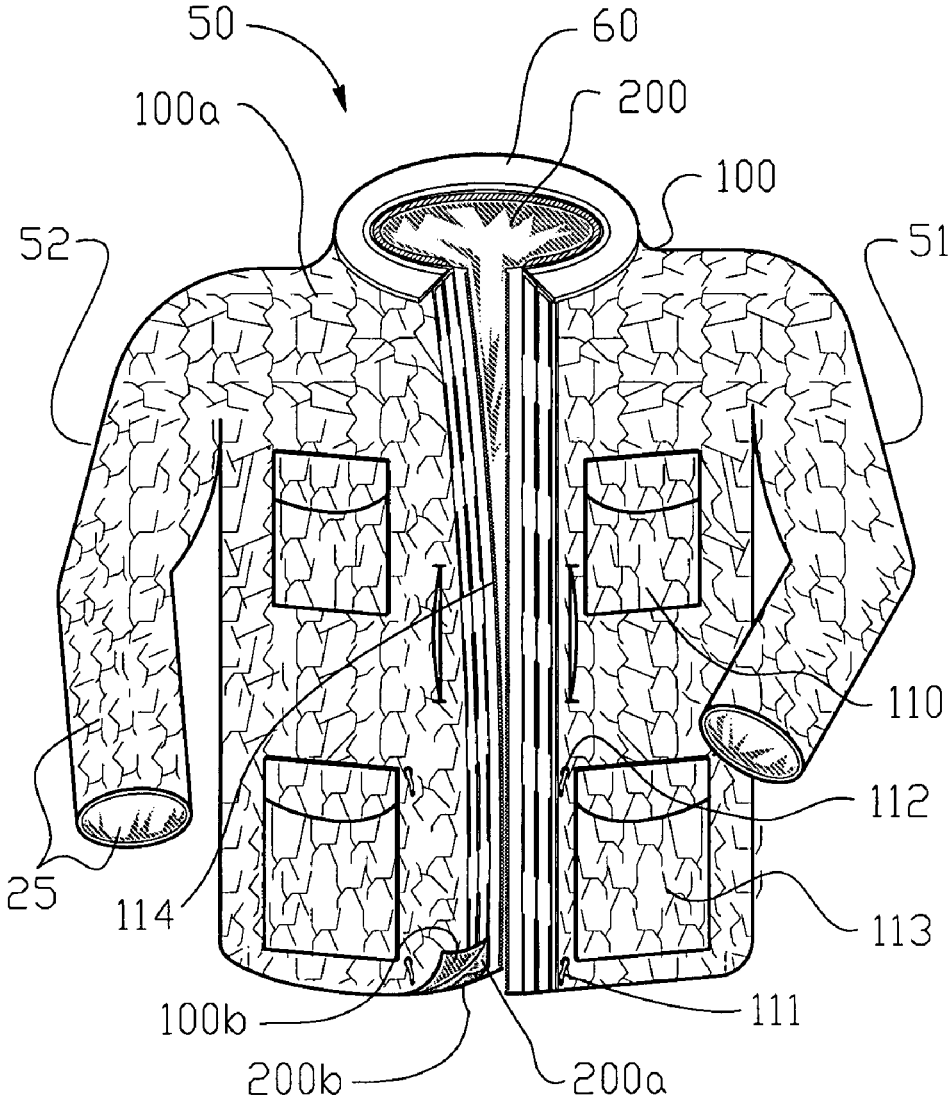
FIG. 1 is a perspective view of double reversible clothing, specifically illustrating a double reversible jacket, according to the preferred embodiment of the present invention.

The best mode for carrying out the invention is presented in terms of its preferred embodiment, herein depicted within the FIGS. 1 through.

1. Detailed Description of the Figures

Figure 8:
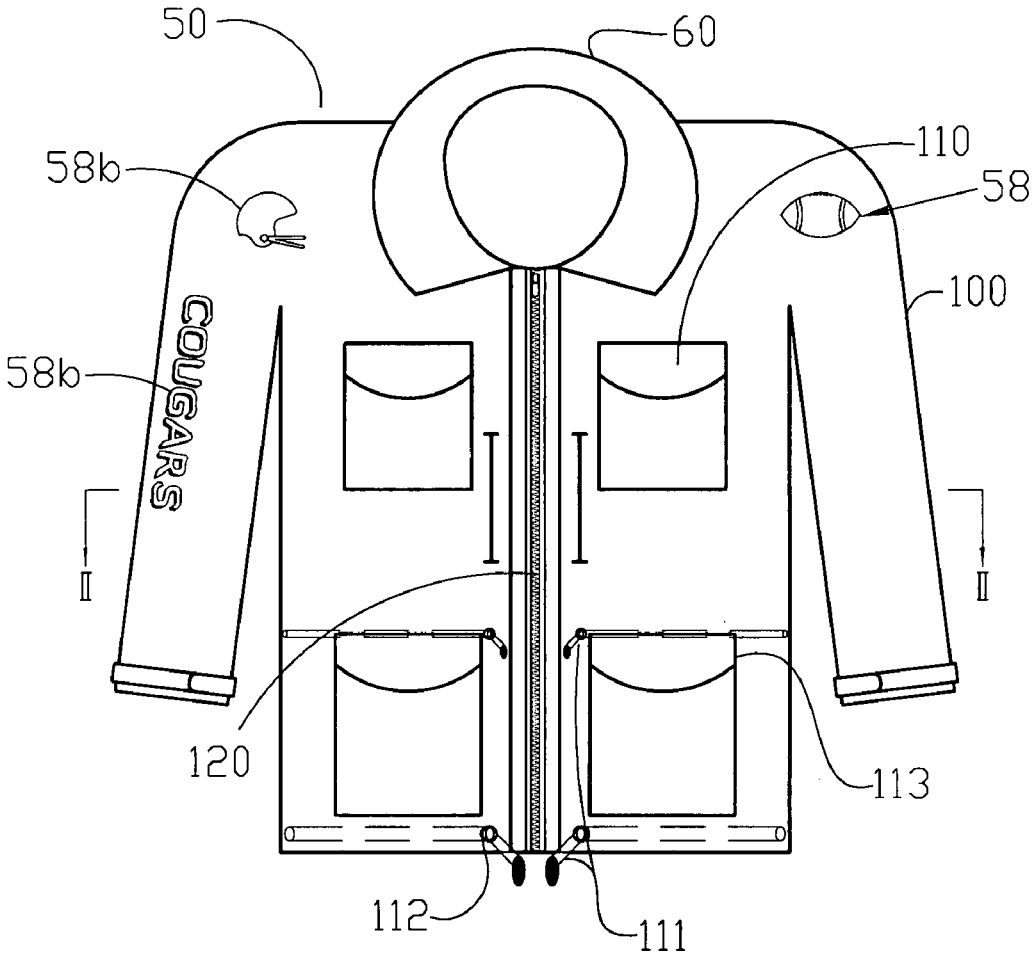
FIG. 8 is a perspective view of a four sided double reversible jacket adorned with team indicia.

Referring now to FIGS. 1-11, double reversible clothing 10 is depicted, according to a preferred embodiment of the present invention. More specifically, a double reversible jacket 50 is depicted in FIGS. 1-8. It is envisioned that the jacket 50 is similar to other commercially available jackets, but provided with double reversibility so as to allow the display of four separate layers containing various prints and indicia. The four-sided double reversible jacket 50 is shown as having at least four different patterns that can be selectively worn and chosen according to the wearer's taste and desire. It is envisioned that the jacket 50 would be a hunter's jacket having four different camouflage styles that are typically associated with the seasons of spring, summer, fall, and winter. It is further envisioned that the jacket 50 would display sports team logos 58, for example, representing one's favorite racing team 58*a* (FIG. 7), and a jacket 50 representing one's favorite professional/college sports team 58*b* (FIG. 8). Two of the patterns are printed on a first shell 100, one pattern printed on the outer surface 100*a* and the other printed on the inner surface 100*b*. The remaining two patterns are printed on a second shell 200, one pattern printed on the outer surface 200*a* and one printed on the inner surface 200*b*. The first shell 100 and second shell 200 are essentially identical in shape except for differences related to the double reversible nature of the double reversible clothing 10. In all possible configurations of the jacket 50, four large, rectangular-shaped pockets with flaps secured by hook and loop fasteners are located on the front of the jacket 50. Two of the pockets are upper pockets 110 located on either side of a central first zipper 120 in the breast area. Two of the pockets are lower pockets 113 located on either side of first zipper 120 located in the abdomen area. Also located on the front of jacket 50 in each of the possible four configurations are a pair of drawstrings 111 penetrating each shell 100, 200 by a series of four brass grommets 112, allowing for conventional drawstring function.

Each shell 100, 200 is formed nearly identically to each other, and each is formed with a left sleeve 51 opposite the central zipper 115 to the right sleeve 52. Further, the central zipper 120 has a flap 114 that overlays the zipper 120, and is formed of a linearly elongated tab-like structure extending laterally inward from the inner seam of the shell 100 (and 200).

Figure 2:
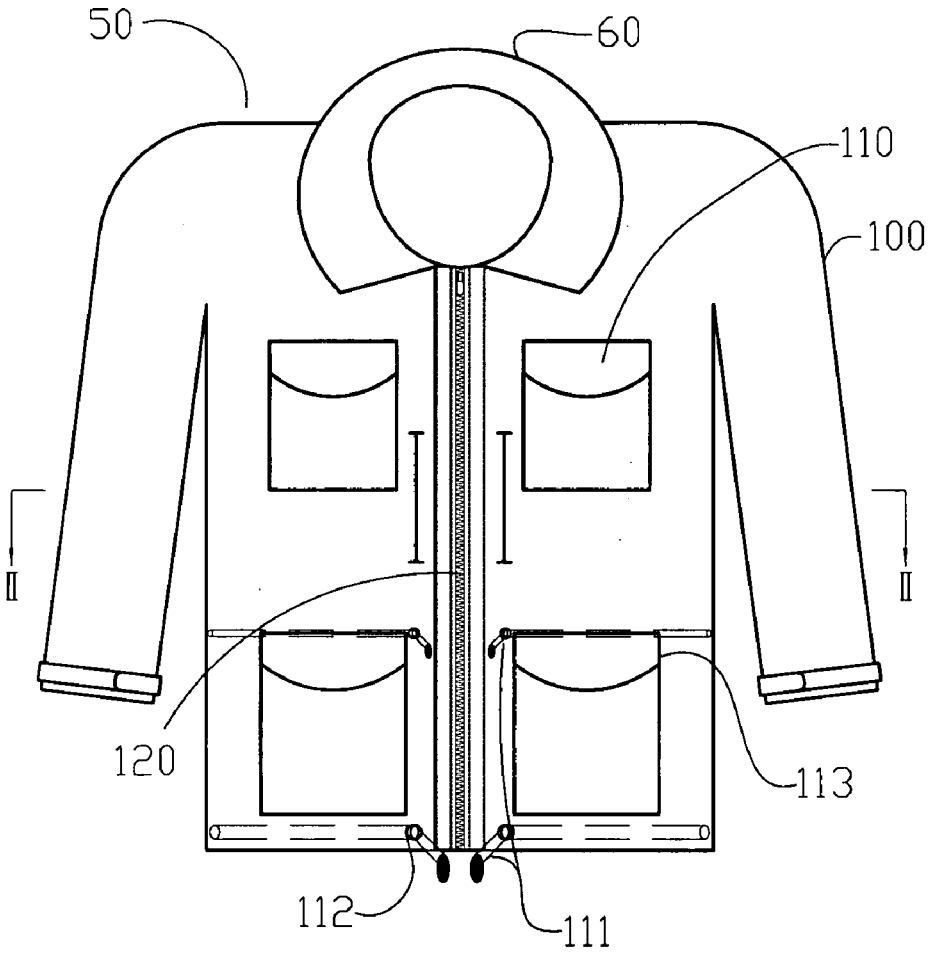
FIG. 2 is a perspective view of a four sided double reversible jacket wherein the inner shell is partially removed from the second shell, according to the preferred embodiment of the present invention.

Referring to FIG. 2, the first shell 100 of the jacket 50 is shown in greater detail. For purposes of the functionality of the present invention, the first shell 100 has an outer surface that forms a first camouflage 25 pattern specific to a summer camouflage pattern, such as a conventional tan dessert camouflage pattern, and an inner surface that forms a second camouflage pattern specific to a spring camouflage pattern, such as a conventional green forest camouflage pattern. Formed in a conventional jacket configuration having a pair of separate front breast panels connected by a reversible zipper, the outer surface forms a zipper flap that extends past one breast panel to cover the zipper when closed. A collar 60 extends outward from a neck hole formed by the jacket 50. Inevitably, the seam connection formed at the collar 60 has the first camouflage 25 pattern in the inside surface of the collar 60 and the second camouflage 25 pattern on the outside surface of the collar 60.

On the upper surface of each breast panel is formed an upper pocket 110. Each upper pocket 110 is formed of a patch affixed to the outer surface of the first shell 100 attached over an orifice penetrating the outer shell 100. Similarly, a patch is affixed over the orifice penetrating the first shell 100 on the inner surface. Each patch is sealed on three sides, with a pocket flap attached along the upper opening such as to fold downward over the upper pocket opening. This similar configuration on each of the inside surface and outside surface allows each upper pocket 110 to have an outer access to a common inner pocket volume regardless of which surface is positioned to the outside. In order to maintain the contents of each upper pocket 110 during the process of reversing the jacket 50, each flap is secured to the pocket 110 by use of a conventional fastener, envisioned as a hook and loop fastener.

On the lower surface of each breast panel is formed a lower pocket 113. Each lower pocket 113 is formed of a patch affixed to the outer surface of the first shell 100 attached over an orifice penetrating the first shell 100. Similarly, a patch is affixed over the orifice penetrating the first shell 100 on the inner surface. Each patch is sealed on three sides, with a pocket flap attached along the upper opening such as to fold downward over the upper pocket opening. This similar configuration on each of the inside surface and outside surface allows each lower pocket 113 to have an outer access to a common inner pocket volume regardless of which surface is positioned to the outside. In order to maintain the contents of each lower pocket 113 during the process of reversing the coat, each flap is secured to the pocket 113 by use of a conventional fastener, envisioned as a hook and loop fastener.

Similarly, the second shell 200 has an outer surface that forms a third camouflage 25 pattern specific to a winter camouflage pattern, such as a conventional white winter camouflage pattern, and an inner surface that forms a pattern specific to hunting such as a safety orange, or conventional DAY-GLO(™) orange camouflage pattern.

Figure 3:
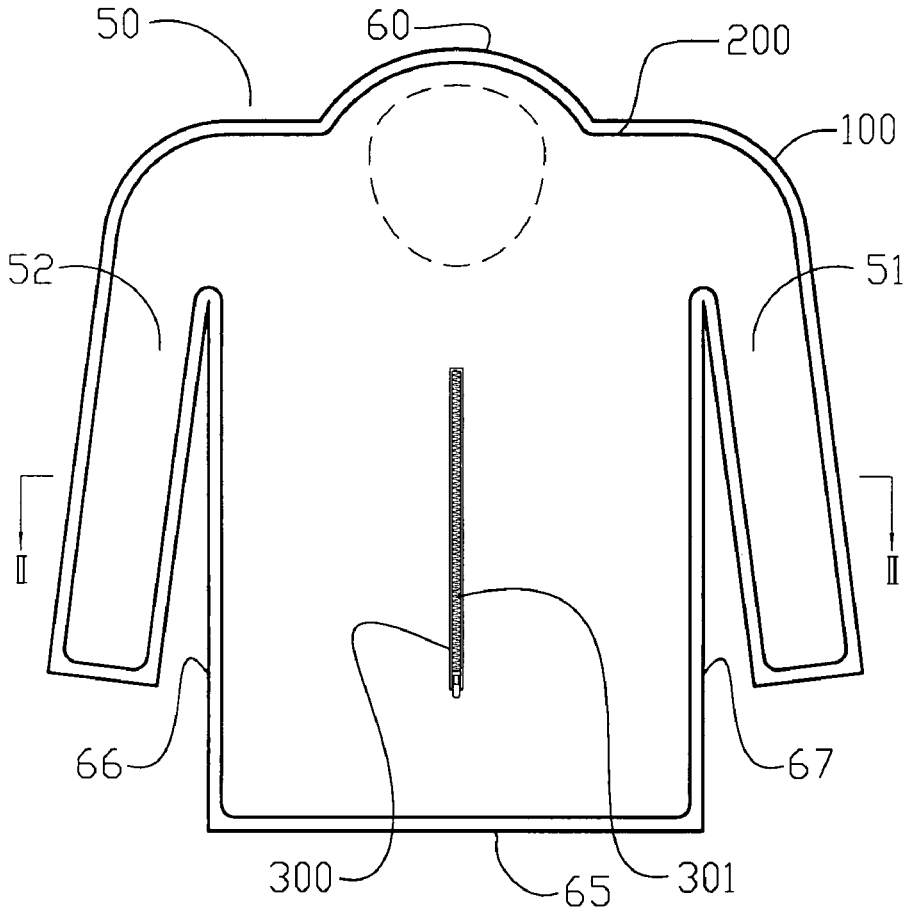
FIG. 3 is a rear view of a second shell 200 of the four sided double reversible jacket, according to the preferred embodiment of the present invention.
Figure 4:
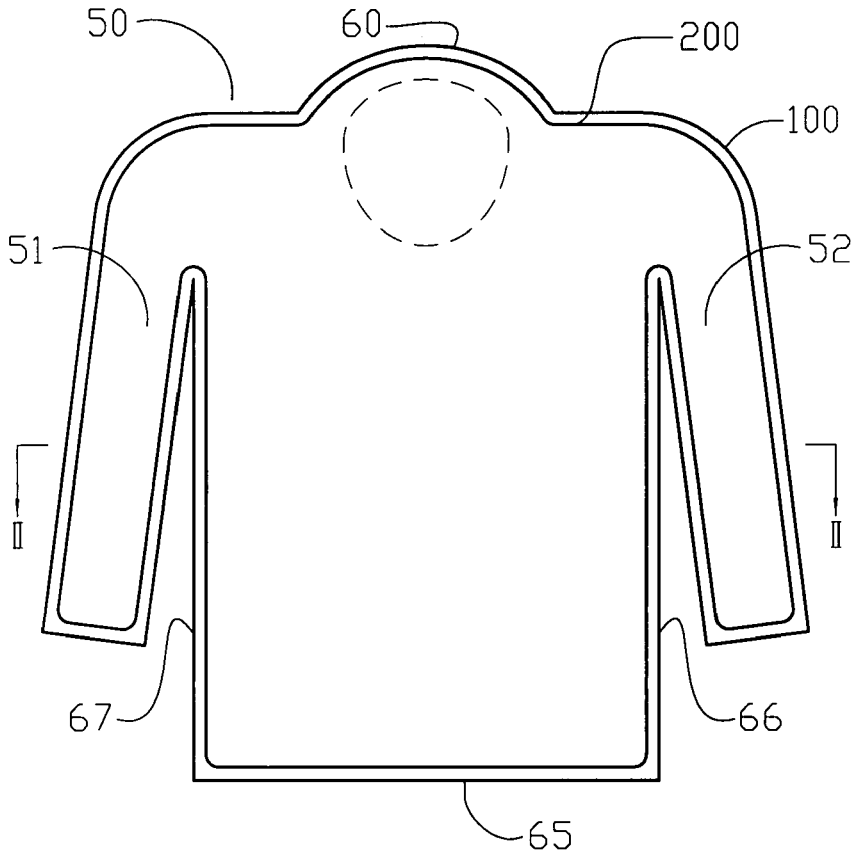
FIG. 4 is a rear view of a first shell 100 of the four sided double reversible jacket, according to the preferred embodiment of the present invention.

FIG. 3 and FIG. 4 show a rear view of the first shell 100 and second shell 200, respectively. As shown the shells are attached about the right side by a right seam 66 and about the left side by a left seam 67. When seamed along the sleeves 51, 52 and collar 60 the second shell 200 can rest directly within the first shell 100. The first shell 100 having an otherwise conventional back panel includes a central slit 300 formed vertically within the central area of the back panel. Affixed within this slit 300 is a reversible zipper 301 that allows the slit 300 to be opened or closed. As shown, no slit is formed in the second shell 200.

Figure 5:
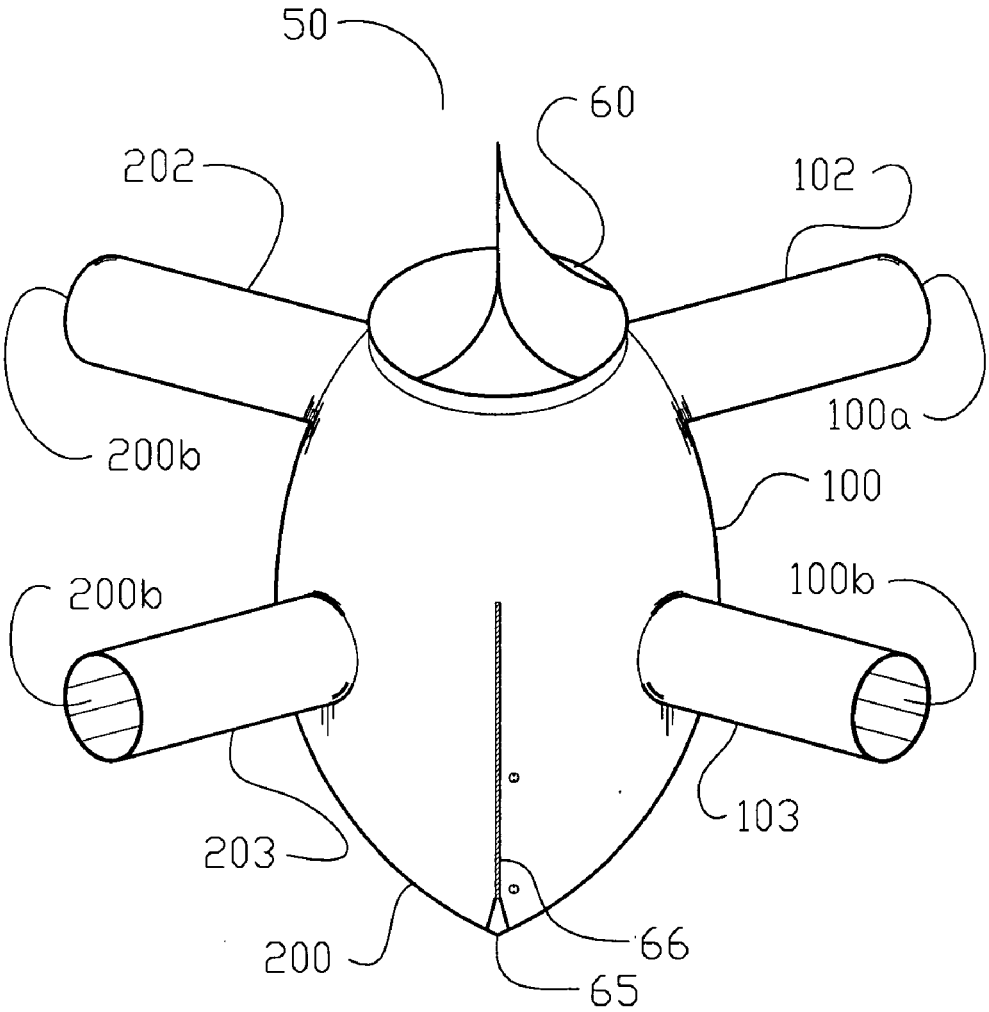
FIG. 5 is a cutaway front view of a four sided double reversible jacket taken along line III-III of FIG. 3, according to the preferred embodiment of the present invention.
Figure 6:
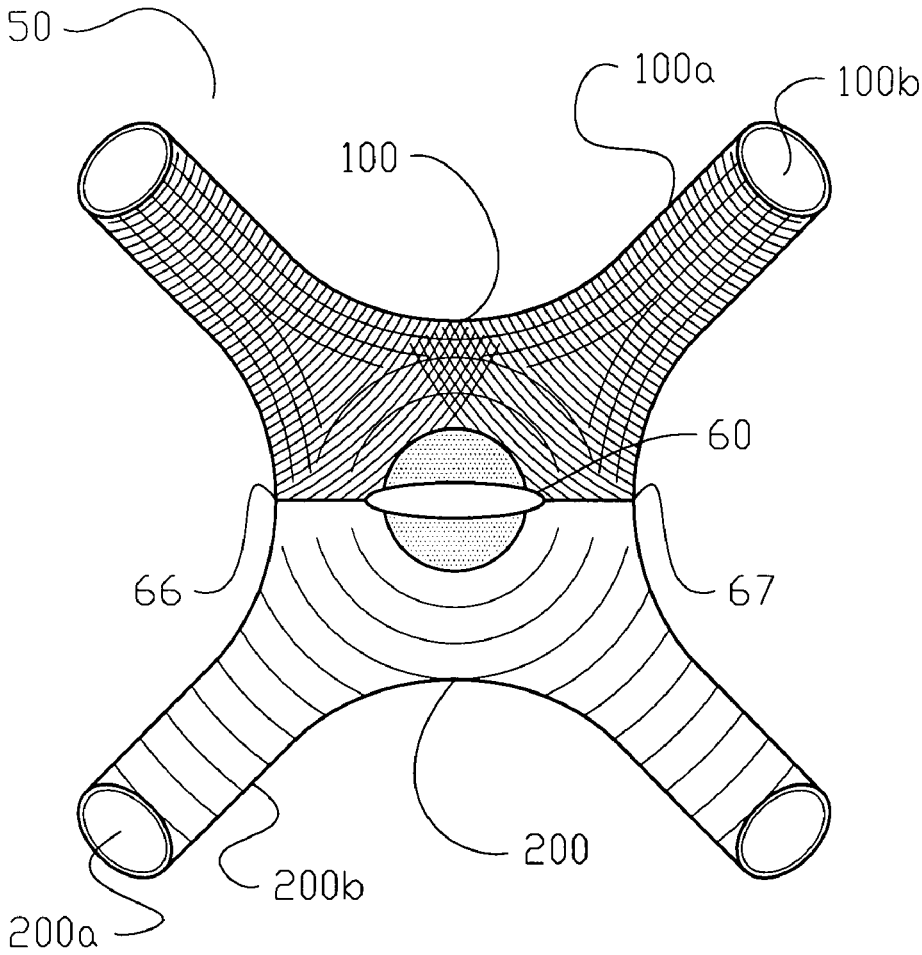
FIG. 6 is a perspective view of a four sided double reversible jacket showing how the first shell 100 is pulled through the second shell 200, according to the preferred embodiment of the present invention.
Figure 7:
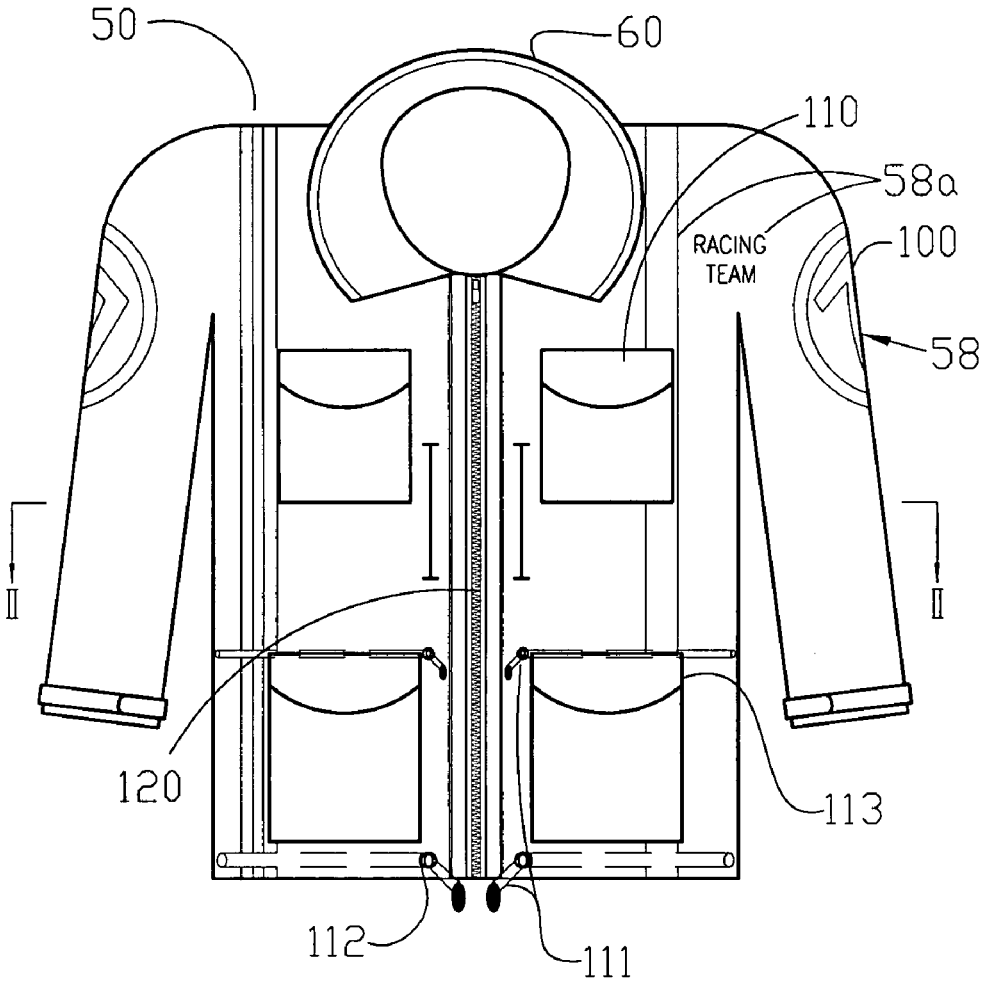
FIG. 7 is a perspective view of a four sided double reversible jacket adorned with racing indicia.

According to FIG. 5 and FIG. 6, a cutaway front view and top perspective of a four sided double reversible hunter's jacket showing how the inner shell is pulled through the outer shell are shown, respectively. As shown, the first shell 100 is affixed to the second shell 200 about their periphery by a lower seam 65, right seam 66, left seam 67, and along the collar 60 only. In this manner, the first shell 100 can be pulled inside out, as shown, from the second shell 200 in the manner shown such that the first shell right arm 103 can be pulled from, (or optionally inserted within) the second shell right arm 203. Similarly, the first shell left arm 102 can be pulled from, (or optionally inserted within) the second shell left arm 202.

Figure 9:
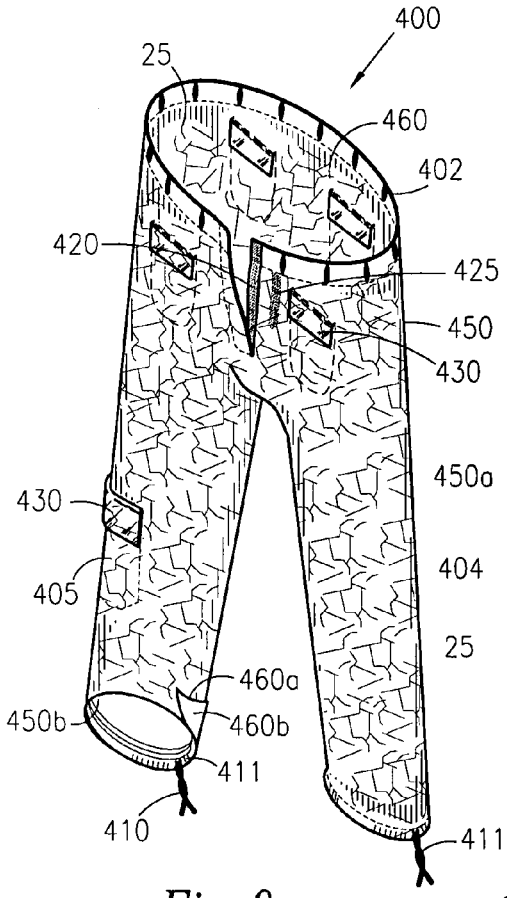
FIG. 9 is a perspective view of four sided double reversible pants.

Referring now to FIG. 9, double reversible pants 400 define a plurality of belt loops 402 about the upper circumference of the pants, wherein the belt loops 402 are integral to the circumference so that a belt 425 may be inserted into all the reversible layers of the pants 400. Allowing for the belt 425 to penetrate all the reversible layers permits the belt to fully support the pants 400 regardless of which particular print or indicia is exposed for display. The double reversible pants 400 are fabricated essentially in the same manner and configuration as the double reversible jacket 50, except for differences being inherent to a pant rather than a jacket. Specifically, the double reversible pants 400 has at least four different patterns that can be selectively worn and chosen according to the wearer's taste and desire. It is envisioned that the pants 400 would be hunter's pants having four different camouflage 25 patterns that are typically associated with the seasons of spring, summer, fall, and winter. It is further envisioned that the pants 400 would display sports team logos 58, for example, representing one's favorite racing team 58*a*, and pants 400 representing one's favorite professional/college sports team 58*b*. Two of the patterns are printed on a first shell 450, one pattern printed on the outer surface 450*a* and the other printed on the inner surface 450*b*. The remaining two patterns are printed on a second shell 460, one pattern printed on the outer surface 460*a* and one printed on the inner surface 460*b*. The first shell 450 and second shell 460 are essentially identical in shape except for differences related to the double reversible nature of the double reversible clothing 10. Each shell 450, 460 is formed with a left pant leg 404 opposite a closable fly 420 to the right pant leg 405. The closable fly 420 is secured via hook and loop material.

In all possible configurations of the pants 400, a plurality of pockets 430 with flaps secured by hook and loop material are located along a front of the pants 400.

A pair of cold weather straps or drawstrings 410 are also provided, one drawstring 410 for each pant leg 404, 405. Of the possible four configurations of the pants 400, the pair of drawstrings 410 penetrate each shell 450, 460 by a series of four brass grommets 411 allowing for conventional drawstring function. Thus, the drawstrings 410 permit a user to draw the bottom of each leg 404, 405 tightly about the leg and prevent the intrusion of cold air, water or other similarly unwanted environmental hindrance or annoyance. The drawstrings 410 are reversible via the series of grommets 411 along the bottom of each leg 404, 405.

Figure 10:
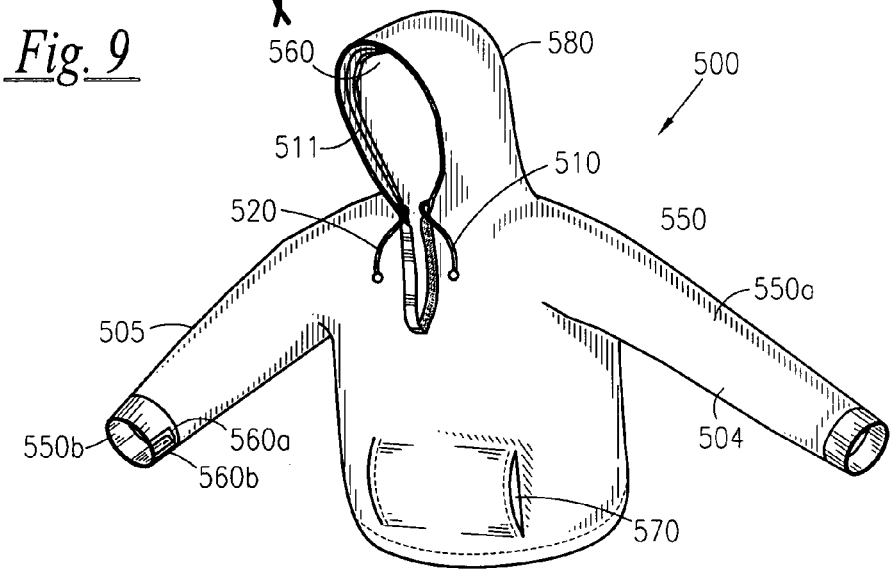
FIG. 10 is a perspective view of four sided double reversible hooded sweatshirt.

Referring specifically to FIG. 10, a double reversible hooded sweatshirt 500 is depicted as having similar qualities and characteristics as the pants 400 and jacket 50. Thus, the double reversible hooded sweatshirt 500 is fabricated essentially in the same manner and configuration as the double reversible jacket 50 and pants 400, except for differences being inherent to a shirt rather than a jacket or pants. Specifically, the double reversible hooded sweatshirt 500 has at least four different patterns that can be selectively worn and chosen according to the wearer's taste and desire. It is envisioned that the sweatshirt 500 would be a hunter's sweatshirt having four different camouflage 25 patterns that are typically associated with the seasons of spring, summer, fall, and winter. It is further envisioned that the sweatshirt 500 would display sports team logos 58, for example, representing one's favorite racing team 58*a*, and a sweatshirt 500 representing one's favorite professional/college sports team 58*b*. Two of the patterns are printed on a first shell 550, one pattern printed on the outer surface 550*a* and the other printed on the inner surface 550*b*. The remaining two patterns are printed on a second shell 560, one pattern printed on the outer surface 560*a* and one printed on the inner surface 560*b*. Thus, the hooded sweatshirt 500 is capable of adjustment to display four separate layers containing various prints or indicia through reversible adaptation. The first shell 550 and second shell 560 are essentially identical in shape except for differences related to the double reversible nature of the double reversible clothing 10. Each shell 550, 560 is formed with a left sleeve 504 opposite a closable neck fly 520 to the right sleeve 505. The closable neck fly 520 is closably secured via hook and loop material.

A reversible hood 580 is provided with a pair of cold weather straps or drawstrings 510. Of the possible four configurations of the pants 400, the pair of drawstrings 510 penetrate each shell 550, 560 at the hood 580 by a series of four brass grommets 511 allowing for conventional drawstring function. Thus, the drawstrings 510 permit a user to draw an external periphery of the hood 580 tightly about one's face and head, thereby preventing the intrusion of cold air, water or other similarly unwanted environmental hindrance or annoyance. The drawstrings 510 are reversible via the series of grommets 511.

An open-ended, reversible pocket 570 is provided about a lower front abdomen region.

Figure 11:
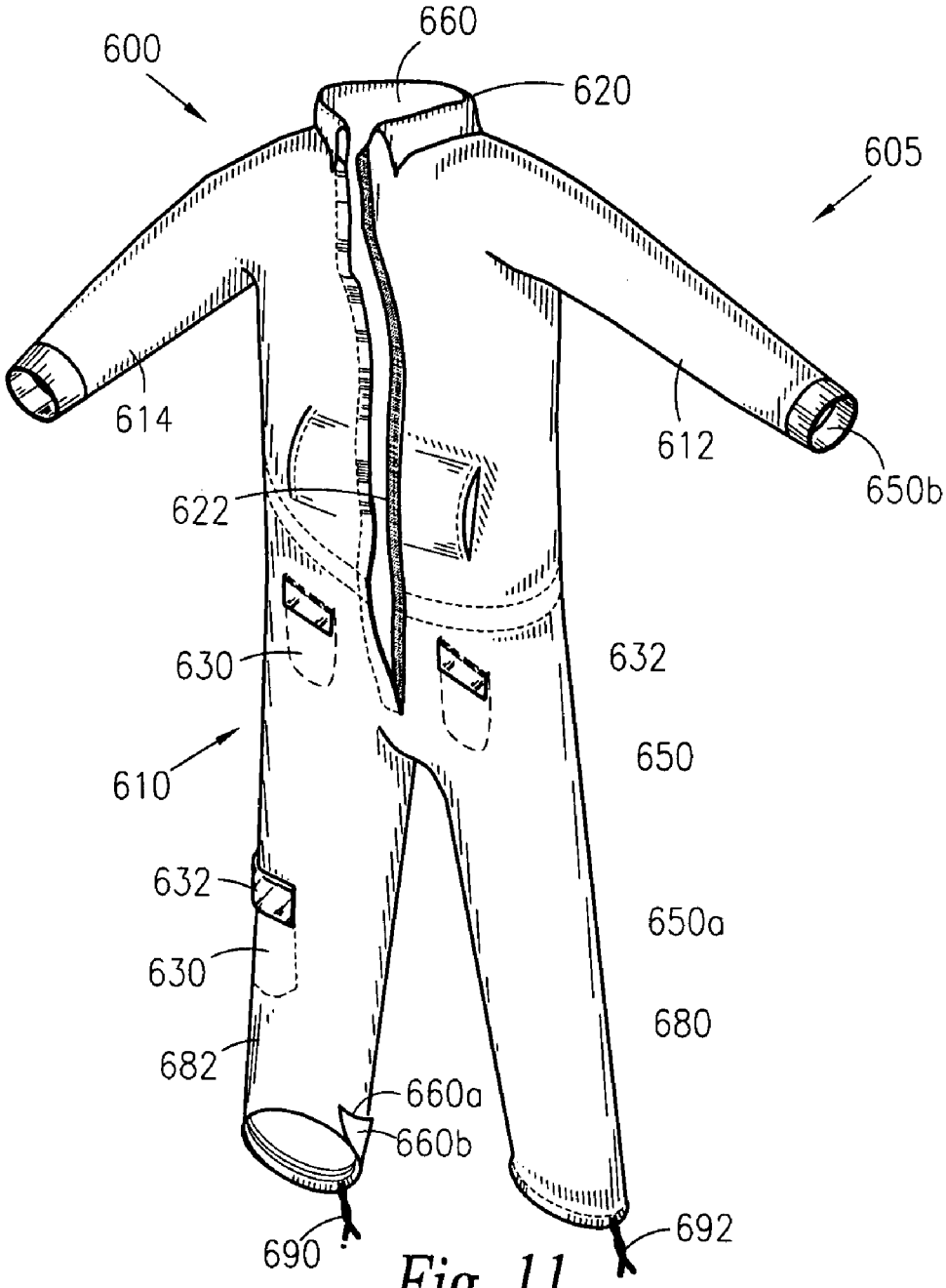
FIG. 11 is a perspective view of four sided double reversible coveralls.

Finally, referring specifically to FIG. 11, double reversible coveralls 600 are depicted having the double reversible qualities previously disclosed. The coveralls 600 have similar qualities and characteristics as the pants 400, jacket 50, and sweatshirt 500. Thus, the double reversible coveralls 600 are fabricated essentially in the same manner and configuration as the double reversible jacket 50, pants 400, and sweatshirt 500, except for differences being inherent to coveralls rather than a jacket, pants, or a sweatshirt. Specifically, the double reversible coveralls 600 have at least four different patterns that can be selectively worn and chosen according to the wearer's taste and desire. It is envisioned that the coveralls 600 would be hunter's coveralls having four different camouflage 25 patterns that are typically associated with the seasons of spring, summer, fall, and winter. It is further envisioned that the coveralls 600 would display sports team logos 58, for example, representing one's favorite racing team 58*a*, and coveralls 600 representing one's favorite professional/college sports team 58*b*. Two of the patterns are printed on a first shell 650, one pattern printed on the outer surface 650*a* and the other printed on the inner surface 650*b*. The remaining two patterns are printed on a second shell 660, one pattern printed on the outer surface 660*a* and one printed on the inner surface 660*b*. Thus, the coveralls 600 are capable of adjustment to display four separate layers containing various prints or indicia through reversible adaptation. The first shell 650 and second shell 660 are essentially identical in shape except for differences related to the double reversible nature of the double reversible clothing 10. Each shell 650, 660 is formed having an upper torso portion 605 integrally joined by a lower torso portion 610, wherein upper torso portion 605 includes a left sleeve 612 opposite a closable collar 620 to the right sleeve 614. Each shell 650, 660 of the upper torso portion 605 bifurcates into a left pant leg 680 and a right pant leg 682 so as to form the lower torso portion 610. The closable collar 620 is closably secured via hook and loop material forming an elongated slit 622 extending downward from a front of collar 620 of the upper torso portion 605 to a crotch region of lower torso portion 610.

The coverall 600 further defines a reversible, open-ended front pocket 670 near a waistline region, and a plurality of reversible pockets 630 approximating pants pockets being located at various locations of each pant leg 680, 682. The plurality of reversible pockets 630 are each provided with flaps 632 secured by hook and loop fasteners.

A pair of cold weather straps or drawstrings 690 are also provided, one drawstring 690 for each pant leg 680, 682. Of the possible four configurations of the coveralls 600, the pair of drawstrings 690 penetrate each shell 650, 660 by a series of four brass grommets 692 allowing for conventional drawstring function. Thus, the drawstrings 690 permit a user to draw the bottom of each pant leg 680, 682 tightly about the leg and prevent the intrusion of cold air, water or other similarly unwanted environmental hindrance or annoyance. The drawstrings 690 are reversible via the series of grommets 692 along the bottom of each pant leg 680, 682.

2. Operation of the Preferred Embodiment

The preferred embodiment of the present invention can be utilized by the common user in a simple and effortless manner with little or no training. The double reversible clothing 10 is worn as any otherwise conventional garments. However, upon the desire to change the external appearance of, for example, the double reversible jacket 50, the user can merely reverse the jacket 50 to make the interior surface visibly available. This allows for easy access to two of the four camouflage 25 patterns, and alternatively, access to sports logos 58.

Should the user desire visible access to either of the two camouflage patterns, or sports logos that are directed inside the seamed area, the user opens the zipper 301 allowing the slit 300 to open. At this point, the jacket 50 can be turned inside out and pulled through the slit 300, making available the third and fourth camouflage patterns, or sports logos. The user can thereby select from the two newly-available outer camouflage 25 surfaces, or sports logos 58.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A double reversible clothing, said double reversible clothing comprising:

a first shell having a first outer surface opposite a first inner surface; and a second shell having a second outer surface opposite a second inner surface;

wherein said first shell and said second shell connect to form a four-sided double reversible pants, and wherein said first outer surface having a first camouflage pattern and said first inner surface having a second camouflage pattern, said second outer surface having a third camouflage pattern and said second inner surface having a fourth camouflage pattern.

2. A double reversible clothing, said double reversible clothing comprising:

a first shell having a first outer surface opposite a first inner surface; and a second shell having a second outer surface opposite a second inner surface;

wherein said first shell and said second shell connect to form a four-sided double reversible pants, and wherein said first outer surface having a first sports indicia and said first inner surface having a second sports indicia, said second outer surface having a third sports indicia, and said second inner surface having a fourth sports indicia.

* * * * *